US005297993A

United States Patent [19]

Gullett et al.

[11] Patent Number: 5,297,993

[45] Date of Patent: Mar. 29, 1994

[54] PACKING LIST MANIFEST

[75] Inventors: J. Robert Gullett, Quakertown, Pa.; Raymond M. Goodspeed, Lauderhill, Fla.

[73] Assignee: Moore Business Forms, Inc., Grand Island, N.Y.

[21] Appl. No.: 990,191

[22] Filed: Dec. 14, 1992

[51] Int. Cl.[5] ..... B41L 1/20

[52] U.S. Cl. ..... 462/6; 462/26; 462/46

[58] Field of Search ..... 462/6, 17, 18, 22, 25, 462/26, 27, 28, 29, 46; 283/79, 80, 81

[56] References Cited

U.S. PATENT DOCUMENTS

| | | | |
|---|---|---|---|
| Re. 33,139 | 1/1990 | Ashby | 282/11.5 A |
| 3,987,960 | 10/1976 | Gardiner | 229/74 |
| 4,153,163 | 5/1979 | Alderman | 206/610 |
| 4,493,496 | 1/1985 | Kaluza | 462/6 |
| 4,624,481 | 11/1986 | Kercher | 462/6 |
| 4,688,826 | 8/1987 | Hosoya | 283/79 |
| 4,923,112 | 5/1990 | Dale | 229/69 |
| 4,928,874 | 5/1990 | Henry | 229/74 |
| 4,938,505 | 7/1990 | Gruttemeyer | 282/12 R |
| 4,978,142 | 12/1990 | Kaluza | 283/81 |
| 5,076,489 | 12/1991 | Steidingen | 462/6 |

*Primary Examiner*—Mark Rosenbaum
*Assistant Examiner*—Willmon Fridie, Jr.
*Attorney, Agent, or Firm*—Nixon & Vanderhye

[57] ABSTRACT

A business form is constructed from a top paper ply, a transparent (e.g. Mylar) second ply, a third ply having a carbon spot on its back face, and a fourth paper ply. Indicia imprinted on the first ply is transferred to the fourth ply. The first and third plies are readily removed, and a "pocket" is formed by the second and fourth plies. Strips of transfer tape are on the rear face of the fourth ply, which is slit and has fold lines formed so that it may be folded into a packing list configuration, having a basically sealed construction. The packing list may be readily opened by tearing along perforation lines.

20 Claims, 2 Drawing Sheets

PACKING LIST MANIFEST

BACKGROUND AND SUMMARY OF THE INVENTION

Packing lists are a common type of business form. In a packing list it is desirable to be able to readily attach the form to a package or envelope, possibly retain inserts within it that are visible from the exterior of the package or envelope, desirably be able to apply variable indicia to the form utilizing a printer, and to provide a form construction that allows ready removal and retention of a record sheet. According to the present invention, a business form is constructed that has these desirable attributes. The invention also comprises the business form which has been manipulated in a particular manner so that it is affixed to the package or envelope.

Prior to use as a packing list, the business form according to the invention includes four parts. There is a first, top paper ply which is ultimately used as a record sheet, and a second transparent material ply (e.g. Duravue Mylar) underlying the first ply. A third ply underlies the second ply and has a first face abutting the second ply and a second face of transfer material, such as carbon material. A fourth paper ply underlies the third ply and has a first face which receives indicia transferred from the third ply carbon, and a second face opposite the first face. Selectively activatable adhesive means, such as strips of transfer tape adjacent the third and fourth edges of the fourth ply, are provided on the fourth ply second face. Each of the plies has opposite parallel first and second, and opposite parallel third and fourth, edges. The spacing between the first and second edges of the second and fourth plies is greater than that of the third ply, so that the second and fourth plies can be attached together by adhesive adjacent the first and second edges thereof, yet be unconnected to the third ply at those edges. The third ply is connected at the third edge of the second and fourth plies, but a perforation line is provided adjacent the area of detachment so that the third ply can be readily detached and removed from connection between the second and fourth plies, the second and fourth plies not being connected at the fourth edge thereof. The first ply is readily detachably connected to the other plies, such as by a detachable tractor drive margin (connected to a like margin of the fourth ply).

The business form according to the invention also includes slits formed at an intermediate portion of the second and fourth plies between the first and second edges thereof, with an extension of the slits formed in the first fold line, and defining a top portion (containing a first edge) and bottom portion (containing the second edge) of the form. Second and third fold lines are also disposed in the bottom portion parallel to the third and fourth edges and spaced inwardly from the strips of transfer tape. Perforation lines are also preferably provided adjacent the strips of transfer tape on the opposite sides thereof from the third and fourth edges respectively. In use, after the third ply has been removed from between the second and fourth plies, the form is folded about the first fold line so that the bottom portion underlies the top portion, and is folded about the second and third fold lines so that the strips of transfer tape attach both the top and bottom portions to a package or envelope.

The business form according to the invention not only comprises the four-part form described above, but comprises the particular packing list configuration after detachment of the top ply and removal of the carbon-containing ply.

That is, according to another aspect of the present invention a packing list business form is provided. The packing list business form comprises the following elements: A first, top, transparent material, ply. A second paper ply underlying the first ply, and having a first face with indicia thereon adjacent the first ply, and a second face opposite the first face. Selectively activatable adhesive strips disposed on the second face of the second ply adjacent the third and fourth edges thereof for attaching the second ply to another object. Each of the plies has opposite parallel first and second, and opposite parallel third and fourth, edges, the spacing between the first and second edges of the first and second plies being substantially the same. Means for connecting the second and first plies together adjacent the first, second and third edges thereof. Slits extending through the transfer tape substantially parallel to the first and second edges of the second ply, and defining a first fold line which extends as a continuation thereof, and between them, the slits and first fold line disposed at an intermediate section of the second ply between the first and second edges thereof, and defining a top portion containing the first edge, and a bottom portion containing the second edge. And, second and third fold lines disposed in the bottom portion and extending substantially parallel to the third and fourth edges, and spaced from the third and fourth edges a distance significantly greater than the width of the strips of adhesive, and extending from the first fold line to the fourth edge. The business form also comprises the above described packing list folded about the first, second and third fold lines so that the bottom portion is beneath the top portion and so that the adhesive strips are activated to affix both the top and bottom portions to a package or envelope. The adhesive strips are preferably transfer tape having a release sheet backing, and which been activated by removing the release sheet backing therefrom.

It is a primary object of the present invention to provide an advantageous business form that is particularly suited for use as a packing list manifest that can be folded into a sealed envelope. This and other objects of the invention will become clear from an inspection of the detailed description of the invention and from the appended claims.

BRIEF OF THE DRAWINGS

FIG. 1A is an exploded perspective view showing an exemplary business form according to the present invention;

FIG. 1B : is a schematic end view of the construction of FIG. 1A;

DETAILED DESCRIPTION OF THE DRAWINGS

Figure 1A:
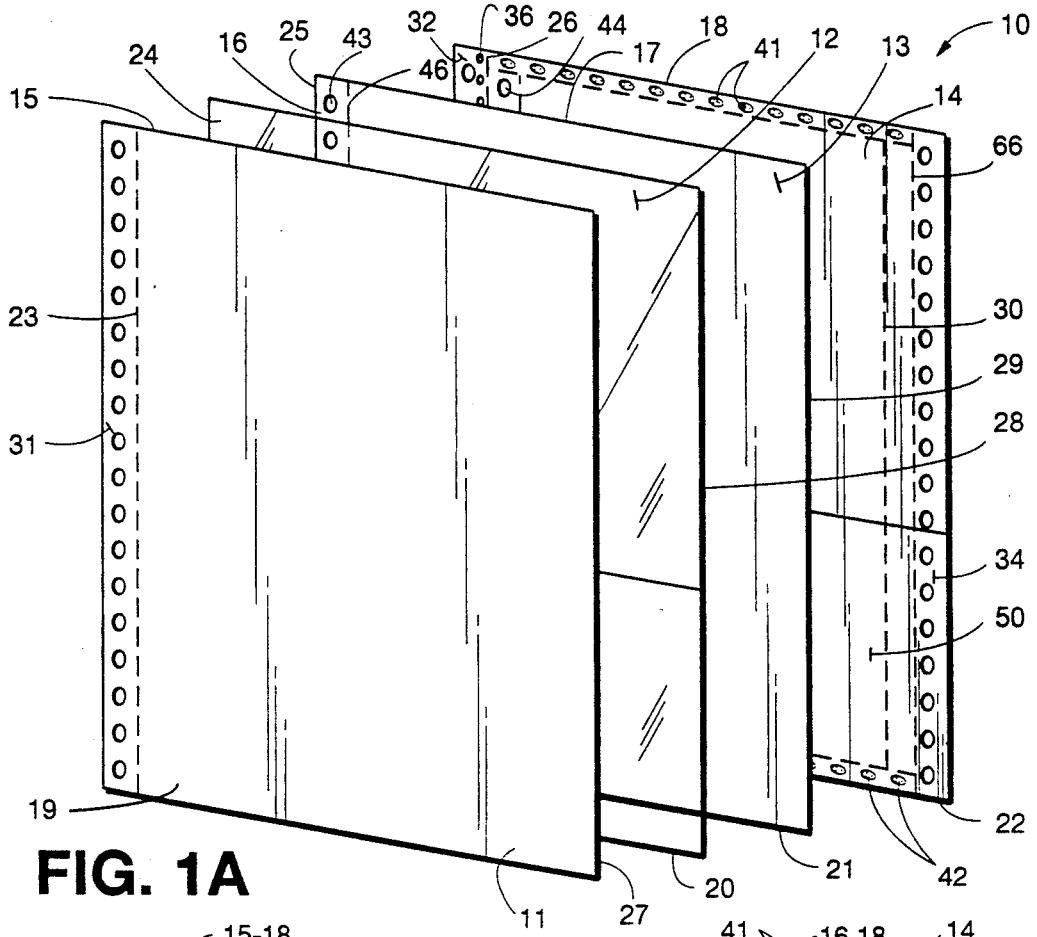
Figure 1B:
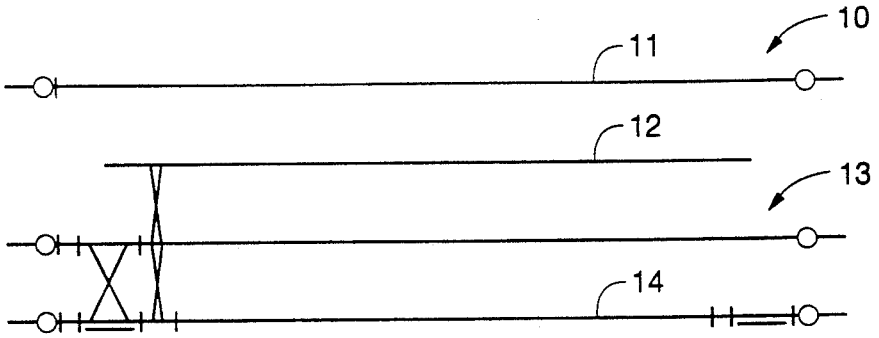

An exemplary business form according to the invention, utilizable to make the packing slip, is shown generally by reference numeral 10 in FIGS. 1A and 1B. The form includes a first or top paper ply 11, a second ply 12 underlying the first ply 11 and of a transparent material (such as Duravue Mylar), a third ply 13 underlying the second ply 12 and capable of transferring indicia impressed (by writing or printing) on the top ply 11 to an underlying ply, and a fourth ply 14 underlying the third ply 13. Each of the plies 11 through 14 has parallel opposite first and second edges, and opposite parallel third and fourth edges. The first edges for the plies 11 through 14 are 15 through 18, respectively, the second edges are 19 through 22, respectively, the third edges 23 through 26, respectively, and the fourth edges 27 through 30, respectively.

Figure 2:
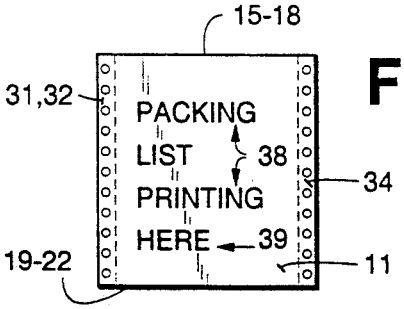
FIG. 2 is a top plan view of the form of FIG. 1 with the components assembled together.

As can be seen in both FIGS. 1A and 2, preferably tractor drive margins are also associated with the form 10 in order to initially feed it through an impact printer. Tractor drive margins may comprise the margin 31 connected along the third edge 23 of the first ply 11, and readily detachable since a third edge 23 comprises perforation lines, and tractor drive margins 32 and 34 associated with the fourth ply 14, the edges 26, 30 being perforation lines. The first ply 11 is readily detachably connected to at least one other ply of the business form 10. This typically is provided by connecting the first ply 11 to the fourth ply 14 at the tractor drive margins 31, 32 thereof. This may be accomplished by deforming the paper forming the margins, or by permanent adhesive, illustrated by dots 36 in FIG. 1 on margin 32.

Figure 3:
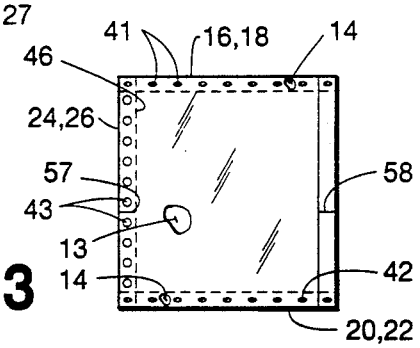
FIG. 3 is a top plan view of the form of FIG. 1 after the top, record sheet has been removed, and with the tractor drive margins removed.

FIG. 2 shows a business form 10 according to the invention (which typically is in continuous format until separated along edges 15 through 18 and 19 through 22 thereof) after it has been run through an impact printer, and the indicia 38, 39 printed thereon. Typically the indicia 38, 39 relates to information for a manifest for a packing list, such as addressee, product, and like information. FIG. 3 shows the form 10 of FIG. 2 after the margins 31, 32, 34 have been removed, and the top, record sheet 11 has been removed. As clear from both FIGS. 1 and 3, the second and fourth plies 12, 14 are connected to each other directly adjacent the first edges 16, 18 thereof and the second edges 20, 22 thereof by permanent adhesive, such as the adhesive dots 41, 42. The plies 12, 14 can be directly connected together since the spacing between the first and second edges 17, 21 of the third ply 13 is significantly less than the spacing between the first and second edges 16, 18 and 20, 22, respectively, of the second and fourth plies 12, 14. All of the second through fourth plies 12 through 14 are preferably connected together at the third edges 24 through 26 thereof, by permanent adhesive, such as glue dots 43, 44.

Figure 4:
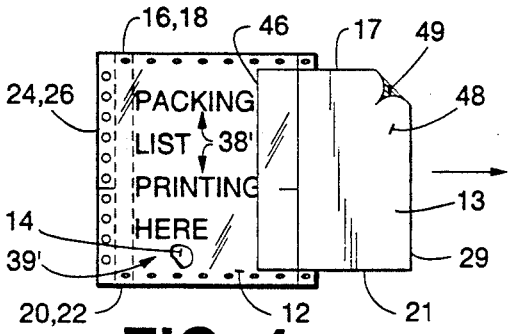
FIG. 4 is a top plan view of the form of FIG. 3, showing the removal of the third, carbon-containing, ply.

The third ply 13 is readily releasably connected to the second and fourth plies 12, 14 adjacent the third edges 24 through 26 thereof by a perforation line (or other line of weakness) 46 (see FIGS. 1A, 3 and 4). Since the plies 12 through 14 are not connected together at the fourth edges 27 through 30 thereof, one can reach into the "envelope" or "pocket" formed by the free edges 27 through 30, grasp the third ply 13 adjacent the edge 29 thereof, and pull on it, severing it along the perforation line 46 so that the third ply 13 can be removed from the "pocket" formed by the plies 12, 14, as illustrated in FIG. 4. FIG. 4 illustrates both the top face 48 and the bottom face 49 of the ply 13, the top face 48 typically being paper and the bottom face 49 being carbon or like image transfer material (such as microcapsules typically used in carbonless formulations). For example, the third ply 13 may be formed from 16 pound carbonizing pad paper, die cut at the top and bottom so that it has a smaller dimension between the first and second edges 17, 21 thereof than do the second and fourth plies 12, 14.

As seen in FIG. 4, note that the indicia 38', 39' appearing on the first face 50 of the fourth ply 14, and of course visible through the transparent second ply 12, is the same as the indicia 38, 39 which has been printed on the first ply 11 (see FIG. 2).

Figure 5:
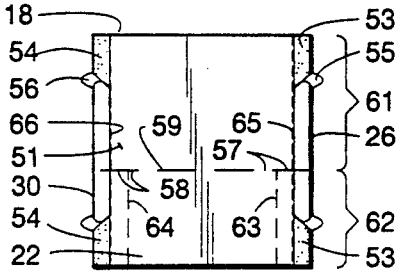
FIG. 5 is a rear plan view of the form of FIG. 4, showing the release material backing for the pieces of transfer tape starting to be removed.
Figure 6:
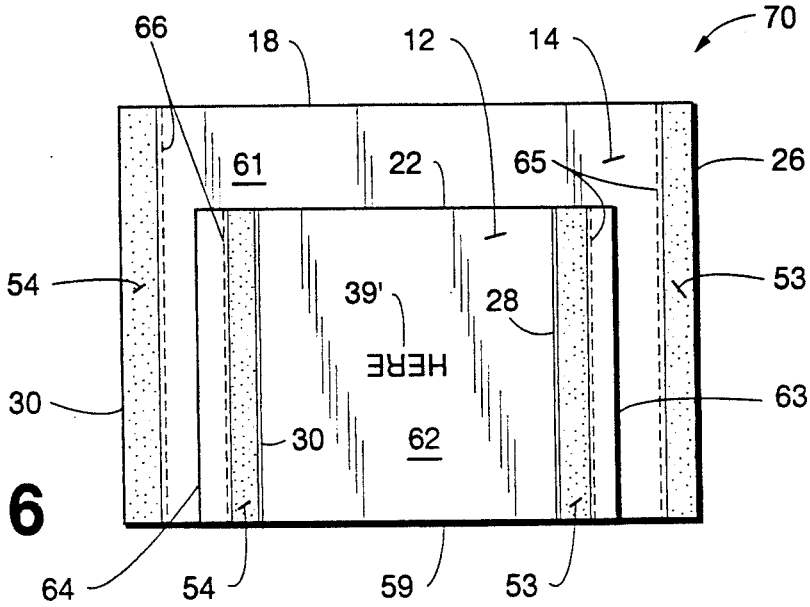
FIG. 6 is a view like that of FIG. 5 but showing the form folded about the first, second, and third fold lines thereof.

FIGS. 5 and 6 show a form according to the invention after removal of the first and third plies 11, 13, from the rear thereof. As seen in FIG. 5, the second face 51 of the fourth ply 14 has adhesive means for connecting a second face 51 to a package or envelope. The adhesive means are in the form strips 53, 54 of adhesive adjacent the third and fourth edges 26, 30, respectively, of the fourth ply 14. The strips of adhesive 53, 54 preferably are constructed by transfer tape, as seen in FIG. 5, the transfer tape comprising the adhesive strips 53, 54 with the release backing 55, 56 (see FIG. 5) covering it. FIG. 6 shows the adhesive strips 53, 54 after removal of the release backing portions 55, 56 therefrom.

The form according to the invention also comprises slits 57, 58 extending inwardly from the edges 26, 30, respectively, through and past the transfer tape strips 53–56, with an extension of the slits forming a fold line 59. The slits 57, 58 and fold line 59 divide the ply 14 into a top portion (containing the first edge 18) 61, and a bottom portion (containing the second edge 22) 62. In the bottom portion 62 are second and third fold lines 63, 64, respectively, which are parallel to the edges 26, 30 and extend from the first fold line 59 to the second edge 22. The slits 57, 58 preferably extend through both the plies 12, 14 all the way from the edges 28, 30 to the second and third fold lines 63, 64. Also, it is preferred that perforation lines 65, 66 are adjacent the transfer tape strips 53–54, on the opposite side thereof from the edges 26, 30.

Figure 7:
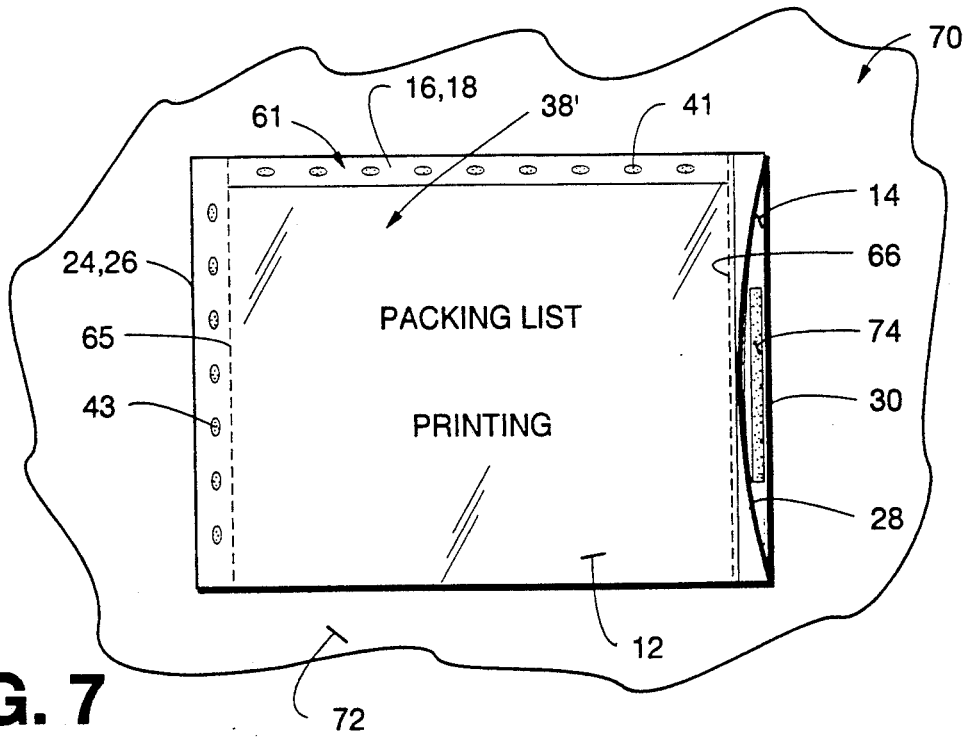
FIG. 7 top plan view of the form of FIG. 6 showing it attached to a package or envelope.

FIG. 6 shows a packing list 70 according to the present invention which is formed from the form 10 after removal of the first and third plies 11, 13, removal of the transfer strip release sheet 55, 56, and folding about the fold line 59, and about the fold line 63, 64, so that the bottom portion 62 underlies the top portion 61. This now may be readily attached to a package or envelope 72—as seen in FIG. 7—the adhesive strips 53, 54, which are on both the top 61 and bottom 62 portions, holding the packing list 70 in place on the package or envelope 72.

Note that the packing list 70 includes a "sealed" envelope in that part of the construction within the bottom portion 62 is "sealed". However, the top part 61—which is the only part visible from the exterior (as seen in FIG. 7) of the package 72—is still open at the fourth edges 28, 30 thereof. Either before or after folding from the FIG. 5 configuration to the FIG. 6 configuration, inserts may be provided between the plies 12, 14 at the fourth edges 28, 30 thereof. If necessary for a particular use, the edges 28, 30 at the top portion 61 may also be sealed together, as by a piece of transfer tape shown in dotted line at 74 in FIG. 7, or by a strip of tape placed thereover. Normally, the top parts of strips 55, 56 are removed but the bottoms of the strips 55, 56 are left on so that the bottom can fold under the top portion.

Preferably, the perforation lines 65, 66 are formed in both the plies 12, 14. In any event, it is a relatively simple matter to remove the packing list manifest from the packing slip 70 merely by grasping the top edges 16, 18 thereof and tearing along the perforation lines 65, 66. Once the top portion 61 is so torn, the bottom portion 62 may also be torn along the perforation lines 65, 66.

It will thus be seen that according to the present invention a desirable business form, and packing list manifest constructed therefrom, have been provided. While the form according to the invention may have any desired dimensions, one particularly desirable construction is one having an approximately eleven inch depth, formed from sheets initially having dimensions of about eleven inches by eleven inches, and producing a sealed envelope having approximate dimensions of 5½-6 inches by about 10¼ inches, in which case the slits 57, 58 have a length of about one inch.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A business form comprising:

a first, top paper ply;

a second, transparent material, ply, underlying the first ply;

a third ply underlying the second ply and having a first face abutting the second ply, and a second face of transfer material opposite the first face;

a fourth paper ply underlying the third ply, and having a first face capable of receiving indicia transfered from the third ply second face transfer material, and a second face opposite the first face;

selectively activatable adhesive means formed on the second face of the fourth ply for attaching the fourth ply to another object;

each of said plies having opposite parallel first and second, and opposite parallel third and fourth, edges, the spacing between the first and second edges of said second and fourth plies being greater than the spacing between the first and second edges of said third ply;

means for connecting the second and fourth plies together adjacent the first and second edges thereof but so the first and second edges of the third ply are not connected thereto, and the second and fourth plies being unconnected at the fourth edges thereof;

means for readily removably connecting the third ply to at least one of the second and fourth plies adjacent the third edges thereof; and means for readily removably connecting the first ply to at least one other ply.

2. A business form as recited in claim 1 wherein the selectively activatable adhesive means on the second face of the fourth ply comprises strips of transfer tape adjacent the third and fourth edges of the fourth ply.

3. A business form as recited in claim 2 further comprising slits extending through the transfer tape substantially parallel to the first and second edges of the fourth ply, and defining a first fold line which extends as a continuation thereof, and between them, the slits and first fold line disposed at an intermediate section of the fourth ply between the first and second edges thereof, and defining a top portion containing the first edge, and a bottom portion containing the second edge.

4. A business form as recited in claim 3 further comprising second and third fold lines disposed in the bottom portion and extending substantially parallel to the third and fourth edges, and spaced from the third and fourth edges a distance significantly greater than the width of the strips of transfer tape, and extending from the first fold line to the fourth edge.

5. A business form as recited in claim 4 further comprising perforation means disposed in at least the fourth ply adjacent the strips of transfer tape on the opposite sides thereof from the third and fourth edges, respectively.

6. A business form as recited in claim 1 wherein the selectively activatable adhesive means includes strips of adhesive adjacent and substantially parallel to the third and fourth edges of the fourth ply; and further comprising slits extending through the strips substantially parallel to the first and second edges of the fourth ply, and defining a first fold line which extends as a continuation thereof, and between them, the slits and first fold line disposed at an intermediate section of the fourth ply between the first and second edges thereof, and defining a top portion containing the first edge, and a bottom portion containing the second edge.

7. A business form as recited in claim 6 further comprising second and third fold lines disposed in the bottom portion and extending substantially parallel to the third and fourth edges, and spaced from the third and fourth edges a distance significantly greater than the width of the strips, and extending from the first fold line to the fourth edge.

8. A business form as recited in claim 7 further comprising perforation means disposed in at least the fourth ply adjacent the strips on the opposite sides thereof from the third and fourth edges, respectively.

9. A business form as recited in claim 1 further comprising common indicia formed on the first ply, and transferred to the fourth ply by the third ply, through the second ply.

10. A business form as recited in claim 9 wherein the third ply is a paper ply having carbon disposed on the second face thereof, which abuts the first face of the fourth ply.

11. A business form as recited in claim 1 wherein the means for connecting the second and fourth plies together adjacent the first and second edges thereof comprises permanent adhesive.

12. A business form as recited in claim 1 wherein the means for readily releasably connecting the third ply to at least one of the second and fourth plies comprises a strip of the third ply adjacent the third edge thereof adhesively secured to the second and fourth plies, and perforation means adjacent said adhesively secured strip.

13. A business form as recited in claim 1 further comprising detachable tractor drive margins disposed adjacent the third edge of the first, third and fourth plies, and adjacent the fourth edge of the fourth ply.

14. A business form as recited in claim 13 wherein the means for readily releasably connecting the first ply to at least one other ply comprises means for connecting the detachable tractor drive margins of the first, third and fourth plies together adjacent the fourth edge thereof.

15. A packing list business form, comprising a first, top, transparent material, ply;

a second paper ply underlying the first ply, and having a first face with indicia thereon adjacent the first ply, and a second face opposite the first face;

selectively activatable adhesive strips disposed on the second face of the second ply adjacent the third and fourth edges thereof for attaching the second ply to another object;

each of said plies having opposite parallel first and second, and opposite parallel third and fourth, edges, the spacing between the first and second edges of the first and second plies being substantially the same;

means for connecting the second and first plies together adjacent the first, second and third edges thereof;

slits extending through the transfer tape substantially parallel to the first and second edges of the second ply, and defining a first fold line which extends as a continuation thereof, and between them, the slits and first fold line disposed at an intermediate section of the second ply between the first and second edges thereof, and defining a top portion containing the first edge, and a bottom portion containing the second edge; and second and third fold lines disposed in the bottom portion and extending substantially parallel to the third and fourth edges, and spaced from the third and fourth edges a distance significantly greater than the width of the strips of adhesive, and extending from the first fold line to the fourth edge.

16. A business form as recited in claim 15 further comprising perforation means disposed in at least the second ply adjacent the strips of adhesive on the opposite sides thereof from the third and fourth edges, respectively.

17. A business form as recited in claim 15 wherein the strips of readily activatable adhesive comprise strips of transfer tape, and wherein said slits also extend through said second, third and fourth plies.

18. A business form as recited in claim 15 wherein the means for connecting the first and second plies together adjacent the first, second and third edges thereof comprise permanent adhesive, and wherein the first and second plies are not connected together adjacent the fourth edges thereof.

19. A business form as recited in claim 16 folded about the first, second, and third lines so that the bottom portion is beneath the top portion, and so that the adhesive strips are activated to affix both the top and bottom portions to a package or envelope.

20. A business form as recited in claim 19 wherein the adhesive strips are transfer tape having a release sheet backing, and which have been activated by removal of the release sheet backing therefrom.

* * * * *